US006038864A

United States Patent [19]

Prade et al.

[11] Patent Number: 6,038,864

[45] Date of Patent: Mar. 21, 2000

[54] BURNER WITH ANNULAR GAP AND GAS FLOW WITH CONSTANT MERIDIONAL VELOCITY THROUGH THE ANNULAR GAP AND GAS TURBINE HAVING THE BURNER

[75] Inventors: Bernd Prade, Mülheim an der Ruhr; Bernhard Schetter, Münster; Holger Streb, Düsseldorf, all of Germany

[73] Assignee: Siemens Aktiengesellschaft, Munich, Germany

[21] Appl. No.: 09/047,164

[22] Filed: Mar. 23, 1998

Related U.S. Application Data

[63] Continuation of application No. PCT/DE96/01756, Sep. 17, 1996.

[30] Foreign Application Priority Data

Sep. 22, 1995 [DE] Germany ..... 195 35 287

[51] Int. Cl.[7] ..... F23R 3/14; F23Q 9/00

[52] U.S. Cl. ..... 60/748; 60/737; 431/284; 431/183

[58] Field of Search ..... 60/742, 746, 748, 60/737; 431/284, 183, 185, 9

[56] References Cited

U.S. PATENT DOCUMENTS

| | | | |
|---|---|---|---|
| Re. 33,896 | 4/1992 | Maghon et al. | 60/748 |
| 3,589,127 | 6/1971 | Kenworthy et al. . | |
| 4,013,377 | 3/1977 | Amos | 415/161 |
| 4,365,753 | 12/1982 | Harding et al. | 60/743 |
| 4,801,261 | 1/1989 | Hagar | 431/9 |
| 5,062,792 | 11/1991 | Maghon | 60/748 |
| 5,101,633 | 4/1992 | Keller et al. | 60/748 |
| 5,165,241 | 11/1992 | Joshi et al. . | |
| 5,251,477 | 10/1993 | Joshi et al. . | |
| 5,259,184 | 11/1993 | Borkowicz et al. | 60/737 |
| 5,323,604 | 6/1994 | Ekstedt et al. . | |
| 5,351,477 | 10/1994 | Joshi et al. . | |
| 5,577,904 | 11/1996 | Dobbeling | 431/8 |
| 5,865,609 | 2/1999 | Sowa et al. | 60/750 |

FOREIGN PATENT DOCUMENTS

| | | |
|---|---|---|
| 0193838 A2 | 9/1986 | European Pat. Off. . |
| 0193838 B1 | 9/1986 | European Pat. Off. . |
| 0589520 A1 | 3/1994 | European Pat. Off. . |
| 3819899 C1 | 11/1989 | Germany . |

OTHER PUBLICATIONS

International Publication WO 92/19913 (Becker , B.), dated Nov. 12, 1992.

International Publication WO 95/04244 (Lemon, D. et al.), dated Feb. 9, 1995.

International Publication WO 95/02789 (Bortz, S.), dated Jan. 26, 1995.

Publication "Ventilatoren" [Ventilators], (Eck, B.), 5$^{th}$ edition, published by Springer Berlin, Heidelberg and New York, Chapter C.

Publication in VGB Kraftwerkstechnik 68 Magazine "Eine wirtschaftliche Lösung des $No_x$–Problems bei Gasturbinen" [An economical solution of $No_x$–problems with gas turbines], (Maghon, H.) dated Aug 1988.

Publication GER–3568C of GE Industrial and Power Systems (Davis, L.B.) "Dry Low $NO_x$ Combustion Systems for GE Heavy–Duty Gas Turbines".

Publishing Company G. Braun, "Axial Compressors" (Horlock, J.H, DE addition 4., dated 1967.

*Primary Examiner*—Ted Kim

*Attorney, Agent, or Firm*—Herbert L. Lerner; Laurence A. Greenberg

[57] ABSTRACT

A burner includes an axis and a configuration which is rotationally symmetrical relative to the axis and includes an outer casing and an inner casing coaxial thereto. The configuration defines an annular gap extending from an inlet to an outlet for guiding a stream of oxygen-containing gas. A multiplicity of nozzles for supplying a fuel to the stream and a swirl lattice are disposed in the annular gap. The configuration including the outer and inner casings is constructed in such a way that the stream flows through the annular gap between the swirl lattice and the outlet at an essentially constant meridional velocity. The burner is particularly suitable for use in a gas turbine.

12 Claims, 2 Drawing Sheets

BURNER WITH ANNULAR GAP AND GAS FLOW WITH CONSTANT MERIDIONAL VELOCITY THROUGH THE ANNULAR GAP AND GAS TURBINE HAVING THE BURNER

CROSS-REFERENCE TO RELATED APPLICATION

This application is a continuation of International Application PCT/DE96/01756, filed Sep. 17, 1996 which designated the Unites States.

BACKGROUND OF THE INVENTION

Field of the Invention

The invention relates to a burner with an axis and a configuration being rotationally symmetrical relative to the latter and including an outer casing and an inner casing coaxial thereto, the configuration defining an annular gap extending from an inlet to an outlet for guiding a stream of oxygen-containing gas, a multiplicity of nozzles disposed in the annular gap for supplying a fuel and a swirl lattice disposed in the annular gap.

The invention relates, in particular, to such a burner for use in a gas turbine.

A burner of that type is disclosed in European Patent 0 193 838 B1, corresponding to U.S. Pat. Nos. 4,701,124 and RE33896 and in an article entitled "Eine wirtschaftliche L ösung des $NO_x$—Problems bei Gasturbinen" [An Economical Solution to the $NO_x$ Problem in Gas Turbines] by H. Maghon, VGB Kraftwerkstechnik [VGB Power Station Technology] 68 (1988), 799. A development of that burner emerges from International Publication WO 92/19913 A1, corresponding to U.S. Pat. No. 5,451,160.

European Pat. Application 0 589 520 A1, corresponding to U.S. Pat. No. 5,381,652, as well as U.S. Pat. Nos. 5,165,241; 5,251,447; 5,323,604; and 5,351,477 are also of interest in that connection. Reference is also to be made to an article entitled "Dry Low $NO_x$-Combustion Systems for GE Heavy-Duty Gas Turbines" by L. H. Davis, Prospectus GER-3568c of GE Industrial and Power Systems, Schenectady, N.Y. Burners or combustion parts with burners for use in gas turbines emerge from all of those documents.

In the case of the relevant teachings of fluid mechanics which are important in the present connection, attention is drawn to a book entitled "Ventilatoren" [Fans] by B. Eck, 5th edition, Springer-Verlag Berlin, Heidelberg and New York 1972, Chapter C, pages 283 to 285, and a book entitled "Axialkompressoren" [Axial compressors] by J. H. Horlock, Verlag G. Braun, Karlsruhe, Germany, 1967, Supplement 4.

Both books relate to fans, particularly fans of the axial type, which are distinguished by a rotating swirl lattice which sucks in a stream of gas in the form of a swirl-free stream along an axis and discharges it in the form of a swirling accelerated stream along the axis. In a burner of the type described, there is a stationary swirl lattice, against which a swirl-free stream that is accelerated in another way flows and from which the stream is discharged with a swirl and with some pressure loss. The configuration of the burner is therefore similar in many respects to the configuration of a fan, and essential theoretical principles of a fan are directly applicable. An effect which occurs on any stream of gas advancing with a swirl along an axis, irrespective of the way in which that stream has been produced, is particularly important in the present case. That effect is the formation of a vortex core within the stream, that is to say a stream advancing with a swirl is inclined to assume the form of an annulus, so that in a central region of a cylindrical tube in which the stream is guided, the central region surrounding the axis, there is no longer any flow in the direction of the stream.

The stream of a gas through a largely randomly selectable configuration of limitations, in particular through a burner, can be calculated through the use of numerical mathematics, for which purpose appropriate computer programs have in the meantime been offered on a commercial scale. Such computer programs are known to persons who are experienced and active in the relative field by the names TASC-FLOW and FLUENT.

A burner of the type mentioned in the introduction in general serves the purpose of burning a fuel reliably and with low pollutant emission in a stream of oxygen-containing gas, in particular in compressed air. Premixing combustion has proved to be beneficial to avoid the formation of pollutants, such as nitric oxides and carbon monoxide. For that purpose, initially as homogeneous a mixture of fuel and oxygen-containing gas as possible is formed, and only that mixture is burnt. For such a mixture, there is in general the possibility of premature ignition, in particular under the conditions which are to be expected in a gas turbine and especially when a relatively easily combustible fuel or one with high flame velocity is to be used. Fuels of that type are, for example, gases which contain elementary hydrogen, for instance gases which are obtained by coal gasification, and natural gases that have high proportions of longer-chain hydrocarbons, wherein the ignition temperatures thereof are clearly lower than the ignition temperature of methane.

In a burner in which such premixing combustion is carried out, as is described in some of the documents mentioned above, in particular in European Pat. 0 193 838 B1, corresponding to U.S. Pat. Nos. 4,701,124 and RE33896, and International Publication WO 92/19913 A1, corresponding to U.S. Pat. No. 5,451,160, further problems may arise if the flow to the burner is not ideal and the mixing of the oxygen-containing gas with the fuel is thereby impaired. In such a case, an inhomogeneous temperature distribution and, correspondingly, an increased production of nitric oxides result during the combustion of the mixture. Furthermore, an inhomogeneous mixture is conducive to premature ignition. Those considerations plainly stand in the way of implementing premixing combustion in a gas turbine, in which an easily combustible fuel is to be burnt. They also show that premixing combustion, such as it has been possible to carry out heretofore, has not been free of problems, particularly because premature ignition of a mixture of fuel and oxygen-containing gas can relatively easily cause serious damage to an affected burner.

SUMMARY OF THE INVENTION

It is accordingly an object of the invention to provide a burner and a gas turbine having the burner, which overcome the hereinafore-mentioned disadvantages of the heretofore-known devices of this general type and which are constructed in such a way that, if possible, no irregularities form in a stream of oxygen-containing gas flowing through the burner and consequently a risk of premature ignition of fuel in the stream is avoided.

With the foregoing and other objects in view there is provided, in accordance with the invention, a burner, comprising an inlet, an outlet, an axis, and a configuration rotationally symmetrical relative to the axis; the configuration including an outer casing and an inner casing coaxial to the outer casing; the configuration defining an annular gap extending from the inlet to the outlet for guiding a stream of oxygen-containing gas; the configuration having a multiplicity of nozzles disposed in the annular gap for supplying a fuel to the stream; the configuration having a swirl lattice disposed in the annular gap; and the configuration guiding the stream through the annular gap between the swirl lattice and the outlet at a substantially or essentially constant meridional velocity.

The feature of an "essentially constant meridional velocity" means that the configuration, through which this stream is to flow, must oppose an essentially constant meridional flow cross-section of the stream. However, this flow cross-section will often not lie, for example, perpendicularly to an axis of symmetry of the structure through which the stream is to flow, but will have to be dimensioned according to a vector field describing the stream, at an angle to the axis of symmetry and transversely to the vector field.

In this connection, a simple computing model, which does not have to take the stream explicitly into account, gives a good approximation for determining the flow cross-section along the configuration through which the stream is to flow: the configuration has tori inscribed into it which touch the surface of the outer casing and the surface of the inner casing tangentially. The points at which such a torus touches the outer casing or the inner casing lie on a circle on the outer casing or on a circle on the inner casing. These two circles span a frustoconical surface which has a surface area that corresponds, in a good approximation, to the effective flow cross-section at the location of the frustoconical surface.

Moreover, computer programs which are used to calculate streams through configurations constructed in virtually any way, are available on a commercial basis. For example, the computer programs TASCFLOW and FLUENT are known to persons who are experienced and active in the relevant field. Preferably, such a computer program is used in order to optimize a structure produced by using the above-described simple computing model. With regard to the present case, it may be noted that it can basically be treated within the scope of a two-dimensional model due to the existing rotational symmetry. There are, of course, no fundamental objections to treating the present case through the use of a three-dimensional model.

The invention proceeds from the knowledge that the guarantee of a constant meridional velocity for the stream downstream of the swirl lattice, that is to say the guarantee of a constant velocity of propagation of the stream along the axis or in a plane radial/axial relative to the axis, has a particularly stabilizing effect on the stream and on that mixture of the oxygen-containing gas and fuel which is to be formed in this stream. In particular, this measure guarantees that disturbances due to a non-ideal flow to the burner are suppressed. A substantial proportion of a necessary pressure drop, which has to be established across the burner, takes place between the inlet and the swirl lattice. This also prevents the risk that disturbances in the stream will occur downstream of the swirl lattice.

In accordance with another feature of the invention, the configuration including the outer casing and the inner casing is constructed in such a way that the annular gap narrows between the inlet and the swirl lattice.

In accordance with a further feature of the invention, for this purpose, the outer casing is constructed, in particular, in such a way that it opens at the inlet in the manner of a lip or a rounded funnel.

In accordance with an added feature of the invention, the inner casing is equipped at the inlet, in particular, with a rounded edge. This contributes to homogenizing the stream passing through the burner and avoids the situation where disturbances which have formed in the stream upstream of the burner continue into the burner.

In accordance with an additional feature of the invention, the nozzles disposed in the annular gap and intended for supplying a fuel are disposed in the swirl lattice. For this purpose, the swirl lattice is formed, in particular, of hollow guide blades, in which the nozzles are disposed. In this way, a particularly homogeneous mixing of the fuel into the stream can be achieved, thus guaranteeing uniform temperature distribution in the stream during combustion and consequently effectively preventing nitric oxides from occurring excessively.

In accordance with yet another feature of the invention, the burner is constructed in such a way that a swirl coefficient, which is defined by the swirl lattice, a radius of the outer casing and a radius of the inner casing, both radii having to be determined at the outlet, and which can be calculated as a quotient between an angular momentum as a dividend and a product of a meridional momentum and a radius of the outer casing as a divisor, with the angular momentum and the meridional moment characterizing the stream at the outlet when the latter flows to the inlet without swirl, is lower than a critical swirl coefficient which is determined by the radii. The requirement, on which the appropriate construction of the burner is based, is known as "Strscheletzky's hub criterion".

It may be pointed out, in the first place, that although the swirl coefficient can be calculated from characteristic variables of the stream, namely the magnitude of a meridional component of its momentum and the magnitude of its angular momentum which is determined essentially by the swirl lattice, the swirl coefficient is nevertheless a characteristic variable of the burner itself. This results from the fluidic similarity relationships.

The term "critical swirl coefficient" was coined on the basis of the observation that a so-called vortex core forms in the vicinity of the axis of a stream moving along the axis with a swirl, that is to say a zone out of which the stream is essentially displaced. This is caused, for example, by centrifugal forces. The diameter of this vortex core is accessible to calculation and the books mentioned above are referred to in this respect. In principle, the diameter of the vortex core increases with an increasing swirl coefficient. If the stream is to move in an annulus which is defined by the radius of the outer casing of the burner as the outer radius and by the radius of the inner casing as the inner radius, a bearing of the flow against the inner casing can be guaranteed only when the vortex core radius resulting from the given outer radius and the given swirl coefficient is smaller than the inner radius. If the radius of the vortex core is larger than the inner radius, this means that a breakaway of the flow from the inner casing occurs, with the immediately understandable risk that there will be a backflow into the burner and a considerable risk of premature ignition of the fuel in the stream. In this connection, the critical swirl coefficient is defined as that swirl coefficient at which the radius of the vortex core of the stream corresponds exactly to the inner radius, that is to say the radius of the inner casing.

The burner swirl coefficient, which is defined as explained, is preferably selected to be clearly lower than the critical swirl coefficient.

In accordance with yet a further feature of the invention, the swirl coefficient of the burner is between 75% and 97% of the critical swirl coefficient and, particularly preferably, is approximately 90% of the critical swirl coefficient. As a result, there is some safe distance between the actual geometry of the burner and a geometry to be considered as "critical" and therefore, there is a quantitative safety, as it were, against a breakaway of the flow from the inner casing.

In accordance with yet an added feature of the invention, there is provided a pilot-burning device.

In accordance with yet an additional feature of the invention, the pilot-burning device includes, in particular, a pilot burner which is disposed in the inner casing and that supplies a small, stably burning flame, at which the mixture of oxygen-containing gas and fuel formed in the burner itself can ignite. This is important when it is desirable to regulate the fuel supply and consequently regulate the heat production of the burner. It has been shown that premixing combustion without stabilization is stable only in a relatively narrow operating range distinguished by a chemical composition which has to be adhered to relatively closely. However, if additional stabilization is provided by a corresponding pilot-burning device, a widening of the operating range, which is important for operating under practical conditions, can be achieved.

With the objects of the invention in view, the burner is particularly qualified for use in a combustion device of a gas turbine and, in particular, is qualified for a gas turbine, in which relatively highly flammable fuels are to be burnt. In this case, the burner is not at all restricted to the combustion of gaseous fuels. In principle, the burner, in a corresponding construction, can be operated with any flowable fuel, in particular with fuel oil and the like.

Other features which are considered as characteristic for the invention are set forth in the appended claims.

Although the invention is illustrated and described herein as embodied in a burner and a gas turbine having the burner, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
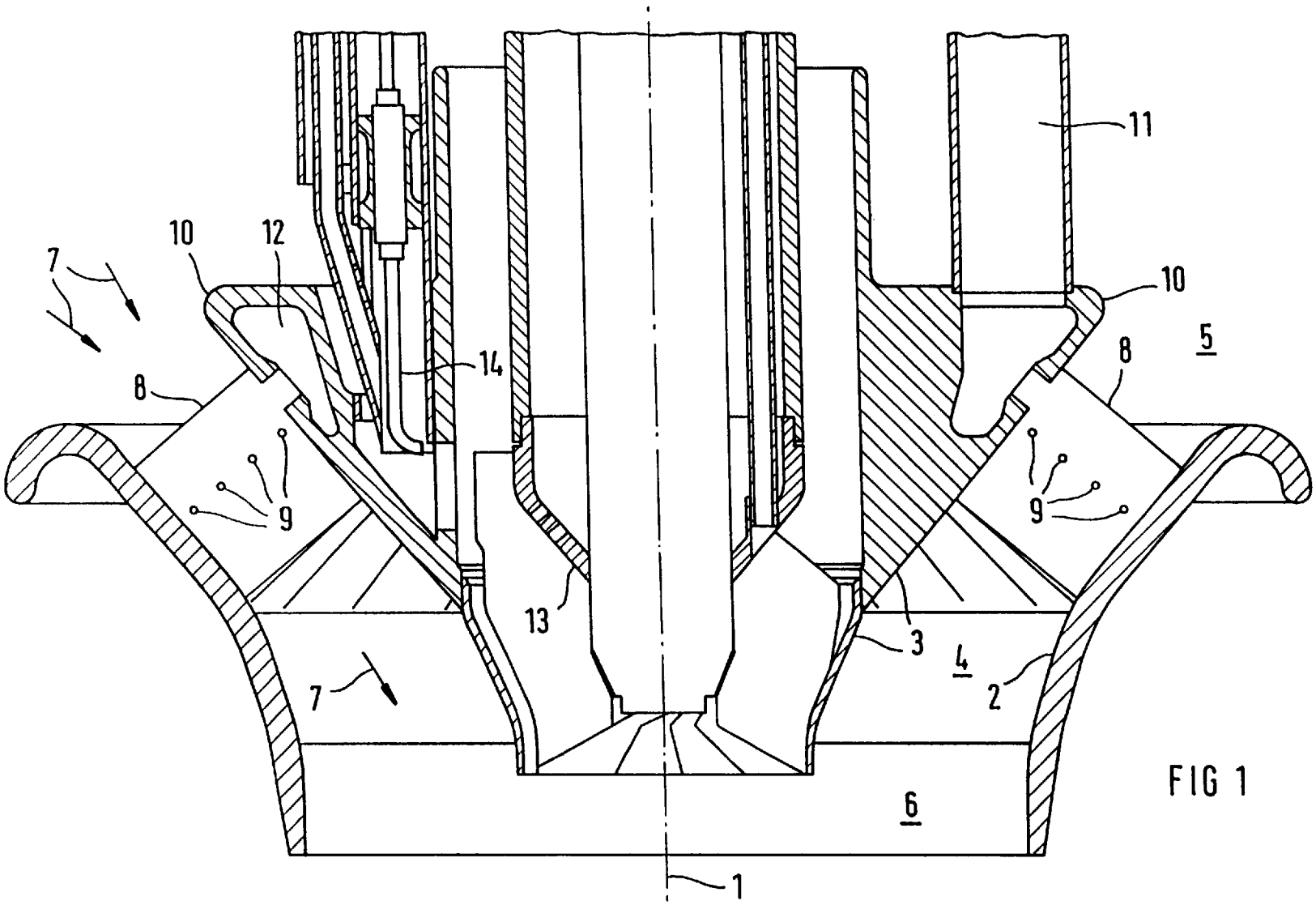
FIG. 1 is a fragmentary, diagrammatic, longitudinal-sectional view of a burner.

Referring now to the figures of the drawings in detail and first, particularly, to FIG. 1 thereof, there is seen a burner which is rotationally symmetrical relative to an axis 1. The burner has an outer casing 2 and an inner casing 3 coaxial thereto. Neither the outer casing 2 nor the inner casing 3 has to be constructed in each case as one part. It is perfectly possible and, for example for reasons of efficient manufacture advantageous, to compose the outer casing 2 and/or the inner casing 3 of a plurality of parts, as shown. The outer casing 2 and the inner casing 3 define an annular gap 4, through which a stream 7 (represented by arrows) of oxygen-containing gas flows from an inlet 5 to an outlet 6. A swirl lattice 8 including a plurality of guide blades 8 which imparts a swirl to the stream 7 is disposed in the annular gap 4. This means that the stream 7 executes a helical movement about the axis 1, downstream of the swirl lattice 8. The stream therefore not only has velocity vectors which lie in planes radial/axial relative to the axis 1 and are accordingly oriented meridionally according to the specialized terminology, but the velocity vectors also have components downstream of the swirl lattice 8 that are oriented tangentially relative to the axis 1 or to circles having centers which are located on the axis 1 and which lie in planes aligned perpendicularly to the axis 1. Such tangential components can also be designated as "circumferential components" in accordance with relevant terminology.

The guide blades 8 have nozzles 9, through which a fuel, in particular a combustible gas, is supplied to the stream 7. The fuel initially mixes with the stream without ignition, and the mixture that is formed only ignites in the region of the outlet 6. The burner is accordingly a premixing burner.

An essential feature of the burner is that the configuration including the outer casing 2 and the inner casing 3 is constructed in such a way that the stream 7 flows through the annular gap 4 between the swirl lattice 8 and the outlet 6 at an essentially constant meridional velocity. This means that the stream 7 should experience no acceleration or deceleration in its direction of propagation, that is to say in a direction which is meridional relative to the axis 1. For this purpose, a careful construction of the outer casing 2 and the inner casing 3 is required in particular, since it may be desirable, and is implemented in the example shown, that the stream 7 does not move simply parallel to the axis 1, but executes a movement that is partially directed radially inwardly relative to the axis 1. This inward movement must be compensated by a corresponding widening of the relevant distance between the outer casing 2 and the inner casing 3, which can be seen clearly from the drawing.

The annular gap 4 narrows markedly upstream of the swirl lattice 8. This narrowing occurs mainly because the stream 7 is guided partially radially inwardly relative to the axis 1, so that it is sufficient to maintain an essentially constant distance between the outer casing 2 and the inner casing 3. In order to assist this, the outer casing 2 is widened, for example in a funnel-like manner, in the region of the inlet 5, so that it opens at the inlet 5 in the manner of a rounded funnel or lip, and the inner casing 3 has a rounded edge 10 at the inlet 5.

The nozzles 9 which serve for supplying the fuel have already been referred to above. These nozzles 9 are disposed in the guide blades 8, in order to thereby ensure particularly homogeneous mixing of the fuel into the stream 7, without the occurrence of breakaways of the flow from the guide blades 8. Fuel is supplied to the nozzles 9 through the use of a fuel conduit 11 and a fuel distribution space 12 disposed annularly on the inside of the inner casing 3. The fuel can flow out of this fuel distribution space 12 through non-illustrated ducts in the inner casing 3 and the guide blades 8, to the nozzles 9.

As already explained in detail above, the geometry of the configuration including the swirl lattice 8, the outer casing 2 and the inner casing 3 is selected in such a way that a swirl coefficient, which defines essential characteristic variables of the stream 7 when the latter enters the annular duct 4 of the inlet 5 in the meridional direction, is lower than a critical swirl coefficient which results from the radius of the outer casing 2 and the radius of the inner casing 3 at the outlet 6. The critical swirl coefficient is defined in such a way that a cylindrical flow, that flows along the axis 1 through a duct having the radius of the outer casing 2, forms a vortex core, that is to say a zone which surrounds the axis 1, out of which the flow is displaced and which has a radius corresponding to the radius of the inner casing 3 of the outlet 6. If the flow in the annular gap 4 has a swirl coefficient which exceeds the critical swirl coefficient, this means that a vortex core having a larger radius than the inner casing 3 in the region of the outlet 6 forms in this flow at the outlet 6. In such a case, in the region of the outlet 6, the flow 7 could no longer bear against the inner casing 3, but would have to break away therefrom. In that case, however, a backflow zone, in which gas could flow back into the annular duct 4, would have to form on the inner casing 3. That would entail a considerable risk of premature ignition of the combustible mixture in the stream 7. The burner is accordingly constructed in such a way as to rule out that risk.

The geometrical structure of the burner was worked out with the aid of familiar mathematical models. In this case, the above-described simple computing model was used first. The model had tori inscribed in it between the outer casing 2 and the inner casing 3. Approximate values for the flow cross-sections in the configuration were determined through the use of the tori. The precondition for fixing the structure is that the flow cross-sections must be constant over the entire critical annular duct 4. The structure which was worked out with the aid of the simple computing model was subsequently optimized with respect to the desired constancy of the flow cross-section over the annular duct 4 by using the commercially available computer program TASCFLOW.

The ignition of the combustible mixture in the stream 7 takes place outside the burner. A pilot-burning device 13, 14 with a pilot burner 13 disposed inside the inner casing 3 is provided for this purpose. The pilot burner supplies a small flame which ensures that the combustible mixture in the stream 7 ignites. An igniter 14 is provided in order to ignite and maintain a flame on the pilot burner 13. Should a special pilot-burning device 13, 14 be dispensed with, a modified igniter for igniting the mixture must, of course, be provided.

Figure 2:
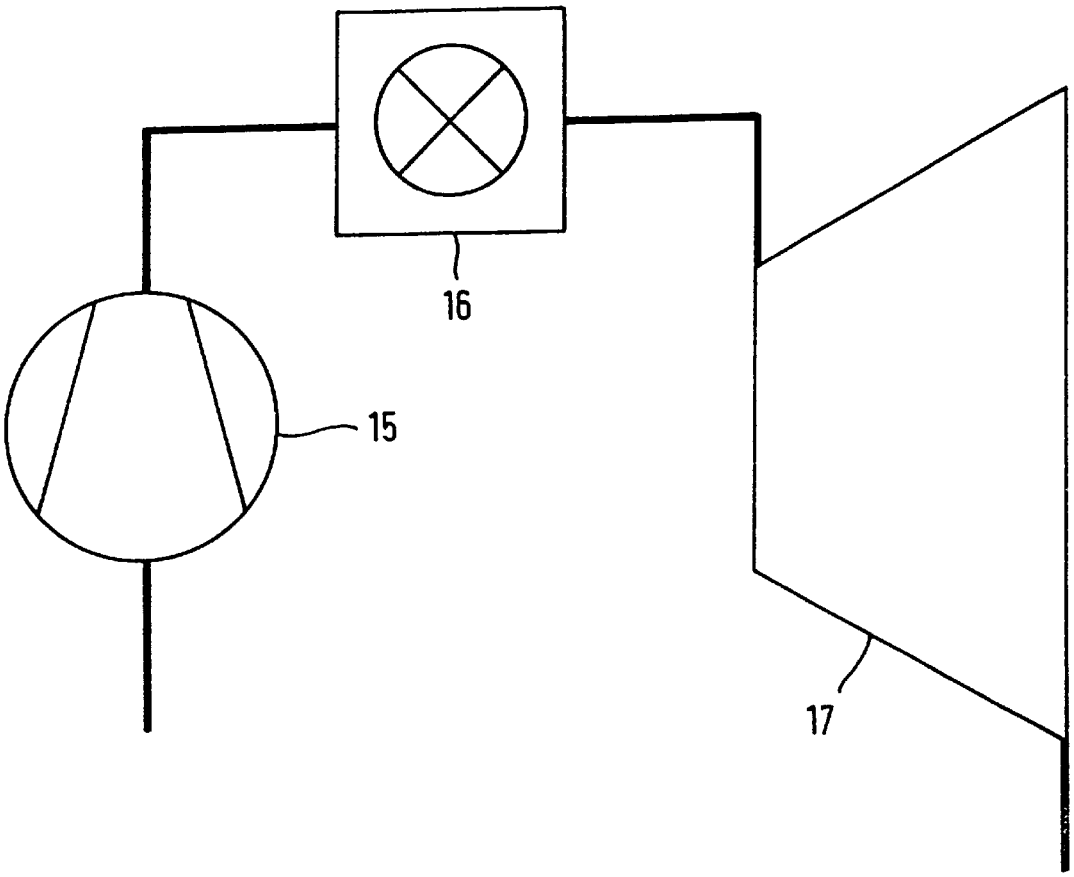
FIG. 2 is a diagrammatic representation of a gas turbine.

FIG. 2 shows a diagrammatic representation of a gas turbine with a compressor part 15 for the intake and compression of air, a combustion part 16 receiving the compressed air to which the fuel provided for combustion is moreover supplied, and a turbine part 17 in which the stream compressed by the compressor part 15 and additionally heated in the combustion part 16 is expanded so as to thereby deliver mechanical power. The burner shown in FIG. 1 is provided for installation into the combustion part 16 together with a plurality of identical burners.

The burner according to the invention is distinguished by features causing a gas stream passing through the burner to be influenced in a way which is particularly advantageous for the desired purpose. The burner is distinguished by particularly stable operation and, in particular avoids operational disturbances due to a non-ideal onflow or due to flashbacks.

We claim:

1. A burner, comprising:

an inlet, an outlet, an axis, and a configuration rotationally symmetrical relative to said axis;

said configuration including a curvilinear outer casing and a curvilinear inner casing coaxial to said outer casing;

said configuration defining a varying annular gap between said casings extending from said inlet to said outlet for guiding a stream of oxygen-containing gas;

said configuration having a multiplicity of nozzles disposed in said annular gap for supplying a fuel to the stream;

said configuration having a swirl lattice disposed in said annular gap for swirling the stream; and said configuration guiding the swirling stream through said varying annular gap between said swirl lattice and said outlet at a substantially constant meridional velocity.

2. The burner according to claim 1, wherein said annular gap defined by said configuration narrows between said inlet and said swirl lattice.

3. The burner according to claim 2, wherein said outer casing opens at said inlet in the manner of a lip.

4. The burner according to claim 3, wherein said inner casing has a rounded edge at said inlet.

5. The burner according to claim 1, wherein said nozzles are disposed in said swirl lattice.

6. The burner according to claim 5, wherein said swirl lattice includes guide blades and said nozzles are disposed in said guide blades.

7. The burner according to claim 1, wherein:

a) said outer casing and said inner casing have radii determined at said outlet;

b) the stream has an angular momentum and a meridional momentum at said outlet when the stream flows to said inlet without a swirl;

c) said swirl lattice and said radii define a swirl coefficient as a quotient between the angular momentum as a dividend and a product of the meridional momentum and the radius of said outer casing as a divisor; and d) the swirl coefficient is lower than a critical swirl coefficient determined by the radii.

8. The burner according to claim 7, wherein said swirl coefficient is between 75% and 97% of said critical swirl coefficient.

9. The burner according to claim 8, wherein said swirl coefficient is approximately 90% of said critical swirl coefficient.

10. The burner according to claim 1, including a pilot-burning device.

11. The burner according to claim 10, wherein said pilot-burning device includes a pilot burner disposed in said inner casing.

12. A gas turbine, comprising a combustion part including a burner having:

an inlet, an outlet, an axis, and a configuration rotationally symmetrical relative to said axis;

said configuration including a curvilinear outer casing and a curvilinear inner casing coaxial to said outer casing;

said configuration defining a varying annular gap between said casings extending from said inlet to said outlet for guiding a stream of oxygen-containing gas;

said configuration having a multiplicity of nozzles disposed in said annular gap for supplying a fuel to the stream;

said configuration having a swirl lattice disposed in said annular gap for swirling the stream; and said configuration guiding the swirling stream through said varying annular gap between said swirl lattice and said outlet at a substantially constant meridional velocity.

* * * * *